US007639113B2

(12) United States Patent
Heller

(10) Patent No.: US 7,639,113 B2
(45) Date of Patent: Dec. 29, 2009

(54) ENCLOSED INSULATOR ASSEMBLY FOR HIGH-VOLTAGE DISTRIBUTION SYSTEMS

(75) Inventor: Carl Heller, Brea, CA (US)

(73) Assignee: Impact Power, Inc., Irvine, CA (US)

( * ) Notice: Subject to any disclaimer, the term of this patent is extended or adjusted under 35 U.S.C. 154(b) by 159 days.

(21) Appl. No.: 12/018,133

(22) Filed: Jan. 22, 2008

(65) Prior Publication Data

US 2009/0184796 A1 Jul. 23, 2009

(51) Int. Cl.
*H01H 71/20* (2006.01)
*H01H 85/042* (2006.01)

(52) U.S. Cl. ..... 337/168; 337/169; 337/170; 337/171

(58) Field of Classification Search ..... 337/168–171
See application file for complete search history.

(56) References Cited

U.S. PATENT DOCUMENTS 1,589,161 A * 6/1926 Hilliard ..... 337/281
1,877,319 A * 9/1932 Hoffman ..... 337/214
2,074,913 A * 3/1937 Johnson ..... 337/172
2,112,841 A * 4/1938 Hill ..... 337/280
2,230,955 A * 2/1941 Johnson ..... 337/170
2,584,586 A * 2/1952 Hubbard ..... 337/170
2,793,267 A * 5/1957 Mikos ..... 337/187
2,910,560 A * 10/1959 Stroup et al. ..... 337/174
3,299,235 A * 1/1967 Leonard ..... 337/168
3,594,676 A * 7/1971 Misare ..... 337/180
5,854,582 A * 12/1998 Clark et al. ..... 337/169
6,392,526 B1 * 5/2002 Roberts et al. ..... 337/178
6,462,639 B1 * 10/2002 Farag et al. ..... 337/172
6,583,708 B1 * 6/2003 Smith et al. ..... 337/169
6,593,842 B2 * 7/2003 Haynam et al. ..... 337/171
6,922,132 B2 * 7/2005 Montante ..... 337/174
6,952,154 B2 * 10/2005 Almgren et al. ..... 337/202
7,532,103 B2 * 5/2009 Almgren et al. ..... 337/202
2005/0067185 A1 * 3/2005 Schomer et al. ..... 174/142
2008/0174399 A1 * 7/2008 Benke et al. ..... 337/168

FOREIGN PATENT DOCUMENTS

JP 06150804 A * 5/1994

* cited by examiner

*Primary Examiner*—Anatoly Vortman
(74) *Attorney, Agent, or Firm*—Seldon & Scillieri

(57) ABSTRACT

An enclosed insulator assembly has a generally cylindrical polysiloxane body, a tubular Durethan® core with upper and lower terminals, Multilam™ contacts within the terminals, an arc-quenching tube, and a manually removable handle. Entrance holes in the body accommodate the coupling of external cables to the terminals. A threaded cylinder positioned on the handle's interior accommodates one of an interchangeable cutout fuse tube assembly and disconnect tube assembly and permits the assembly to be inserted into the core as the handle is positioned on the body. Both assemblies have top and bottom fittings with O-rings that prevent weather corrosion between the fittings and terminals. A grooved load interrupter is attached to the bottom fitting of the assemblies to suppress arcing when the assembly is pulled out from the body.

1 Claim, 16 Drawing Sheets

ENCLOSED INSULATOR ASSEMBLY FOR HIGH-VOLTAGE DISTRIBUTION SYSTEMS

BACKGROUND OF THE INVENTION

The present invention relates to an improved enclosed insulator assembly of the type that functions as an electrical cutout fuse and/or as a disconnect switch and, more particularly, to a connect/disconnect switch for overhead and underground circuits in high voltage distribution systems.

BACKGROUND OF THE INVENTION

Electric utility companies have primary and secondary lines for distributing electric power. Primary lines are used to deliver electric power to customer service transformers, which provide electricity to designated geographic areas. Utilities protect these primary lines from overload with circuit breakers or other types of electric current interrupters which trip "off" when a fault condition occurs. (For the sake of brevity, all types of circuit interrupters will hereinafter be referred to as "circuit breakers"; however, it will be known and understood that the use of the term "circuit breaker" includes circuit breakers, cutouts and other types of circuit interrupters.) In the "off" state, the primary line sees an "open" circuit at the location of the "off" circuit breaker, and current will not flow in the circuit. When a fault condition occurs, all customers whose source of electric power is dependent upon the primary line can be without electric service until the cause of the fault is located and repaired. In order to confine power outage to a given area, circuit breakers are connected to the primary lines at or near the customer service transformers. Fuse links installed in the circuit breakers are designed to "blow" (or "open") when a fault occurs; i.e., when the current passing through the fuse link exceeds a predetermined value. When the fuse link opens, it isolates a faulted customer service transformer from the primary line and prevents additional power failures to other areas served by the primary line.

Utilities generally prefer to use enclosed circuit breakers rather than open-type circuit breakers because the enclosed type requires less spacing for the breaker's components. In congested areas, the height of a utility pole is typically shared by power lines and cables from utilities, communications, and television companies, and increased pole height results in increased operations costs. The use of enclosed circuit breakers is therefore one method for reducing operating costs, because pole heights do not need to be increased to accommodate all the material that is installed onto the poles.

One such enclosed circuit breaker in use is the Positect® enclosed insulator assembly. There are other circuit breakers of this type, as well, sold under other brands. For the sake of simplicity, the term "Positect®-type enclosed insulator assembly" will be used to denote all of these. These enclosed insulator assemblies can be used as either a utilities distribution circuit breaker or as a disconnect switch, depending on whether a cutout fuse tube assembly or disconnect tube assembly is utilized within them.

A Positect®-type enclosed insulator assembly comprises a hollow, generally cylindrical porcelain insulator body having a manually removable handle formed from the same material as the body. A generally central co-axial tube formed from a plastic material such as Delrin® resin is supported within the porcelain body, and encloses a manually insertable/removable, generally tubular cutout fuse holder (for operation as a circuit breaker) or manually insertable/removable disconnect switch holder (for operation as a disconnect switch) that is attached to the handle.

Electrically conductive contact surfaces on the insertable holders couple to electrically conductive tulip-type contacts associated with the generally central co-axial tube to place the holder in circuit with the power lines.

As a circuit breaker, the enclosed insulator assembly is typically used for four basic distribution utility applications: 1) protecting distribution transformers (single units or banks), 2) protecting underground risers, 3) protecting capacitor banks, and 4) sectionalizing branch circuits subjected to damage by tree branches. When used to protect transformers or underground risers, a universal fuse link is typically installed within the cutout fuse holder. When used to protect capacitors, an indicating fuse link is typically installed in the cutout fuse holder.

As a disconnect switch, the enclosed insulator assembly is typically used to isolate a geographic area served by the line, and is required to interrupt primary circuits while energized at the required voltage. A gloved utility lineman can isolate an area from the circuit by manually pulling out the handle with attached disconnect switch holder (all referred to as disconnect bayonet) from the body without first de-energizing the entire circuit. When field conditions change (e.g., due to tree growth on private property), an enclosed disconnect switch used for sectionalizing the branch circuit can be converted to a circuit breaker by replacing the disconnect switch holder within the central tube with a cutout fuse holder.

The enclosed design of these insulator assemblies is intended to offer a high degree of safety; their high interrupting capability and their shielded electrically-live parts keep the utility lineman safe and provide animal protection as well. The design is also intended to reduce and keep exhaust blast away from the utility lineman. When connected to these enclosed circuit breakers, transformers, underground risers, and capacitor banks energized at rated voltage and current can be de-energized by a utility lineman by manually pulling out the handle with attached cutout fuse tube assembly (all referred to as cutout bayonet) from the porcelain insulator body. When connected to these enclosed disconnect switches, an energized branch circuit at rated voltage and current can be sectionalized by a utility lineman by manually pulling out the disconnect bayonet from the porcelain insulator body.

The design of the enclosed insulator assembly is also directed to suppressing the electric arc that can occur as either of the bayonets is pulled out from the insulating body. As the attached cutout fuse holder (or attached disconnect switch holder) is removed from the central tube by the pulling out of the handle, an arc can be created between the holder and the central tube from which it is being withdrawn. The arc must be extinguished as quickly as possible. A "load interrupter" is accordingly coupled to the bottom the cutout fuse holder (or disconnect switch holder) to extinguish the arc as the holder is withdrawn. The load interrupter is shaped to compress the arc and the dielectric gas given off as the arc contacts the central tube. As the load interrupter is pulled through the insulator body, it compresses the arc against the central tube.

The Positect™-type enclosed insulator assembly is made from porcelain. Porcelain is heavy and brittle which may cause a long installation time or breakage during transport, handling, or installation. These cause operating costs to increase for a utility. The enclosed insulator assembly also uses lead to secure a threaded cylinder into the handle. Lead is heavy and toxic. Over time, the enclosed insulator assembly is subjected to a variety of weather conditions and air contamination, causing corrosion to occur between the insulator terminals and tube fittings which make it difficult to remove the bayonet.

SUMMARY OF THE INVENTION

The invention herein in an improved Positect™-type enclosed insulator assembly. Briefly, the enclosed insulator assembly for high-voltage distribution systems comprises:

a generally tubular axially-extending outer body formed from a non-brittle, electrically insulating thermoplastic material lighter in weight than porcelain and having a manually removable handle, the outer body having at least one entranceway for permitting cables electrically coupled to the distribution system to enter into the interior of the body;

a threaded cylinder mounted generally coaxially onto the inside of the handle and affixed thereto with epoxy;

an axially-extending threaded tube assembly threadably and securely engaging said cylinder so as to be removable with said handle as a detachably integral component thereof, said tube assembly being selected from the group comprising cutout fuse tube assemblies and disconnect tube assemblies;

an axially extending load interrupter coupled to the tube assembly axially opposite the handle, the load interrupter having a generally tube-shaped body formed from epoxy material and having a plurality of axially extending grooves on its outer periphery, and a plastic tube mounted within the outer body and disposed between first and second terminal means that are adapted to be electrically coupled to the cables, the plastic tube having an inner dimension accommodating the insertion therein of the tube assembly, the tube assembly having first and second connection means for electrically coupling to the distribution system via the first and second terminal means, the internal dimension of the plastic tube and the external dimension of the load interrupter being such that any electric arc created as the tube assembly is withdrawn from the plastic tube is compressed and suppressed therebetween; and a pair of sealing rings respectively positioned with respect to the terminal means and tube assembly to inhibit air flow in the regions where the first and second terminal means are coupled to the first and second connection means.

As explained in greater detail below, the outer insulator body preferably has an inner tubular core formed from a thermoplastic having a sufficiently high mechanical strength, good electrical insulation properties, good resistance to heat and chemicals in the context of the intended application. One excellent thermoplastic is offered under the Durethan® trademark. The core is preferably provided with an exterior polysiloxane covering. The preferred removable handle also has a Durethan® core with an exterior polysiloxane covering. The plastic tube is preferably made from Delrin®. Upper and lower terminals are preferably inserted at opposite end regions of the outer insulator body. Multilam™ contacts are preferably lined on the terminals for contact with upper and lower fittings on either a cutout fuse tube assembly or disconnect tube assembly. The fittings on cutout fuse tube or disconnect tube assemblies preferably have a respective O-rings mounted on them for inhibiting the air flow in the region of the terminals. In accordance with the preferred embodiment, the bottom fittings of the cutout and disconnect tube assemblies include a load interrupter attachment.

By making an enclosed insulator assembly in this fashion, a circuit breaker can be converted to a disconnect switch, and vice-versa, by using the disclosed interchangeable cutout fuse tube assembly or disconnect tube assembly, respectively. In addition, the energized parts are shielded, thus protecting personnel and animals from accidental contact. The O-rings on the fittings inhibit air flow over the contact points, thus preventing corrosion that could weld the contacts together, and impede or prevent safe pulling out of the handle and tube assembly. Furthermore, the load interrupter attached to the bottom of the cutout fuse tube or disconnect tube assemblies provides load break capability.

Other objects, advantages and significant features of the invention will become apparent from the following detailed description, which, taken in conjunction with the annexed drawings, discloses a preferred embodiment of the invention.

It will be understood that orientations described in this specification, such as "up", "down", "top", "side" and the like, are relative and are used for the purpose of describing the invention with respect to the drawings. Those of ordinary skill in the art will recognize that the orientation of the disclosed device can be varied in practice, and that the orientation used herein has been chosen for explanatory purposes only. Similarly, it will be recognized by those skilled in the art that the materials referred to herein, and particularly those identified by trademark, are examples of materials that meet the requirements and specifications mandated by safety concerns and by the use of the invention with electric power lines. Accordingly, other acceptable materials are within the scope of the invention whether known by generic names and/or other trademarks, or comprising other functionally equivalent material.

DETAILED DESCRIPTION OF THE PREFERRED EMBODIMENT

Figure 6:
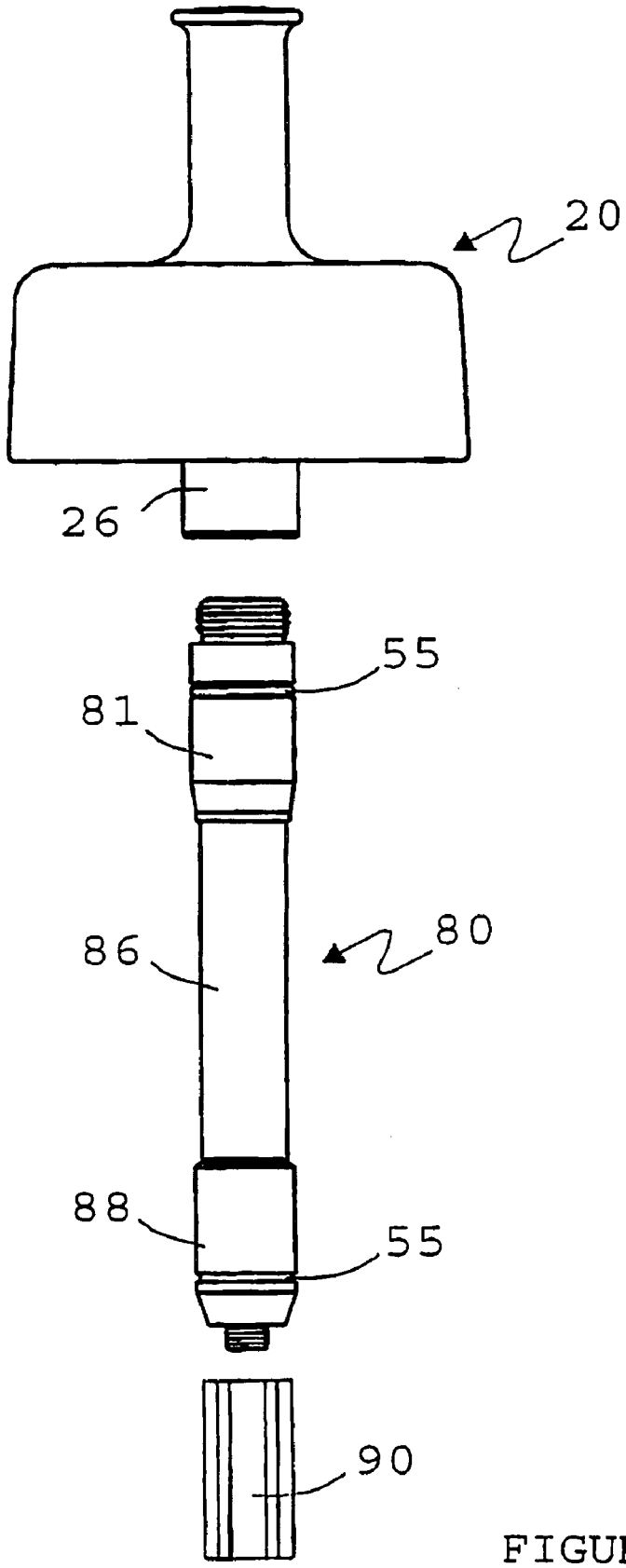
FIG. 6 is a front elevation view, in explosion, of a disconnect switch bayonet assembly constructed in accordance with the invention and showing the handle, disconnect tube assembly with weather-resistant upper and lower O-rings, and grooved load interrupter attachment.

Referring to FIGS. 1-4, an enclosed insulator assembly 10 is illustrated that can be used as a circuit breaker (FIGS. 1 and 3) or a disconnect switch (FIGS. 2 and 4) by simply installing an interchangeable cutout fuse tube assembly 50 (FIG. 7) or disconnect tube assembly 80 (FIG. 6).

Figure 9:
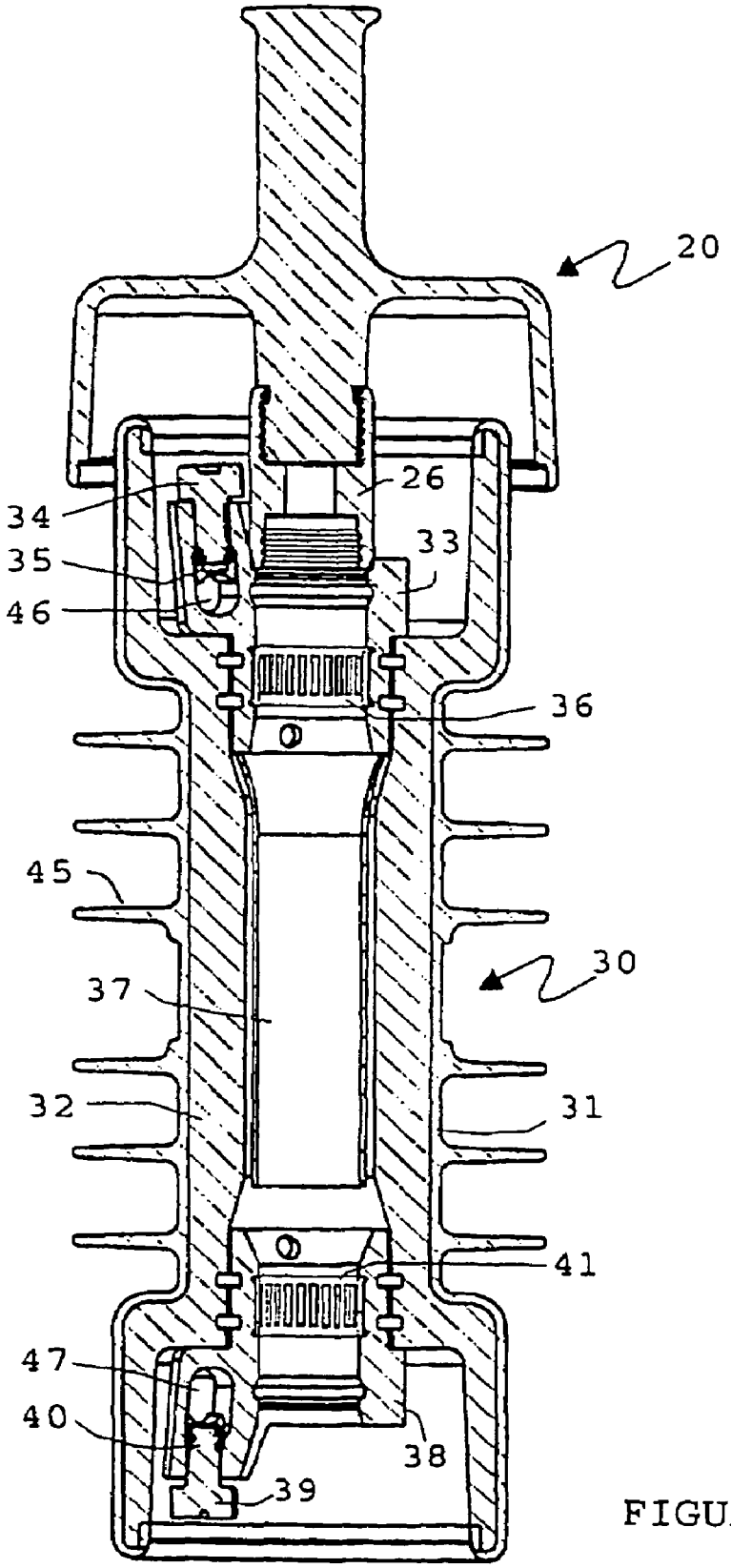
FIG. 9 is a side elevation view in section of the enclosed insulator assembly, without load interrupter attachment, taken along line 2-2 of FIGS. 1-4.

The enclosed insulator assembly preferably comprises a removable handle 20 and tubular body 30. As best illustrated in FIG. 9, the tubular body 30 and handle 20 comprise an inner tubular thermoplastic core 32 having sufficiently high mechanical strength, good electrical insulation properties and good resistance to heat and chemicals in the context of the intended application. One excellent thermoplastic is offered under the Durethan® trademark. The outer surface of the thermoplastic core of the body and handle is covered with a polymer coating 31, preferably a silicone coating such as polysiloxane. One acceptable material is Dow Coming's SE90166UL material. The resulting body 30 and handle 20 are non-brittle, electrically insulating and lighter in weight than porcelain. Returning to FIGS. 1 and 3, the preferred assembly is shown to further comprise a first pair of jumper cable entries 42 near the top of the assembly, and a second pair of jumper cable entries 44 near the bottom of the assembly.

Figure 1:
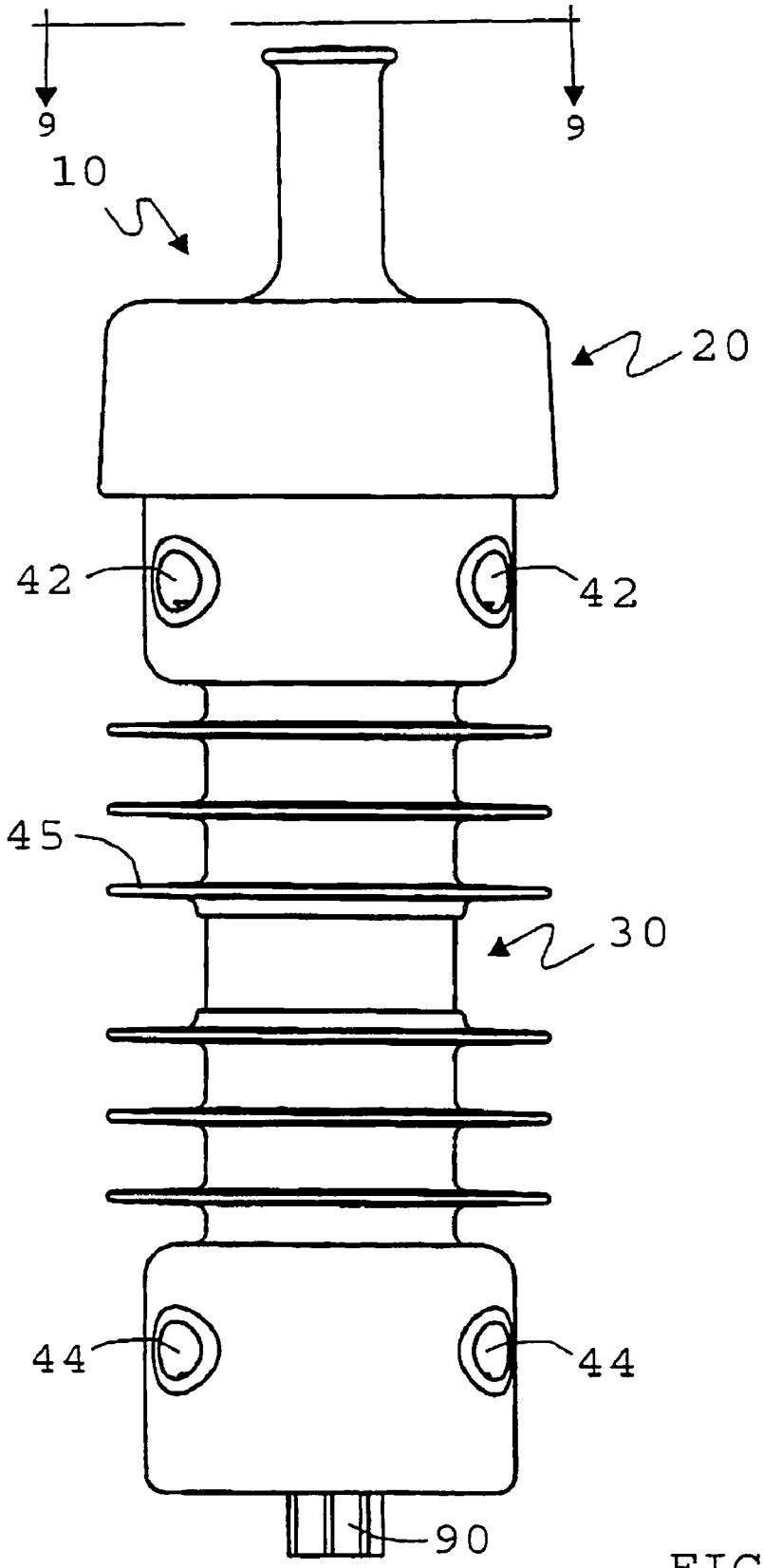
FIG. 1 is a front elevation view of an enclosed bayonet-type silicone disconnect switch assembly, without clamp strap, with load interrupter installed onto the disconnect tube assembly according to the present invention.
Figure 2:
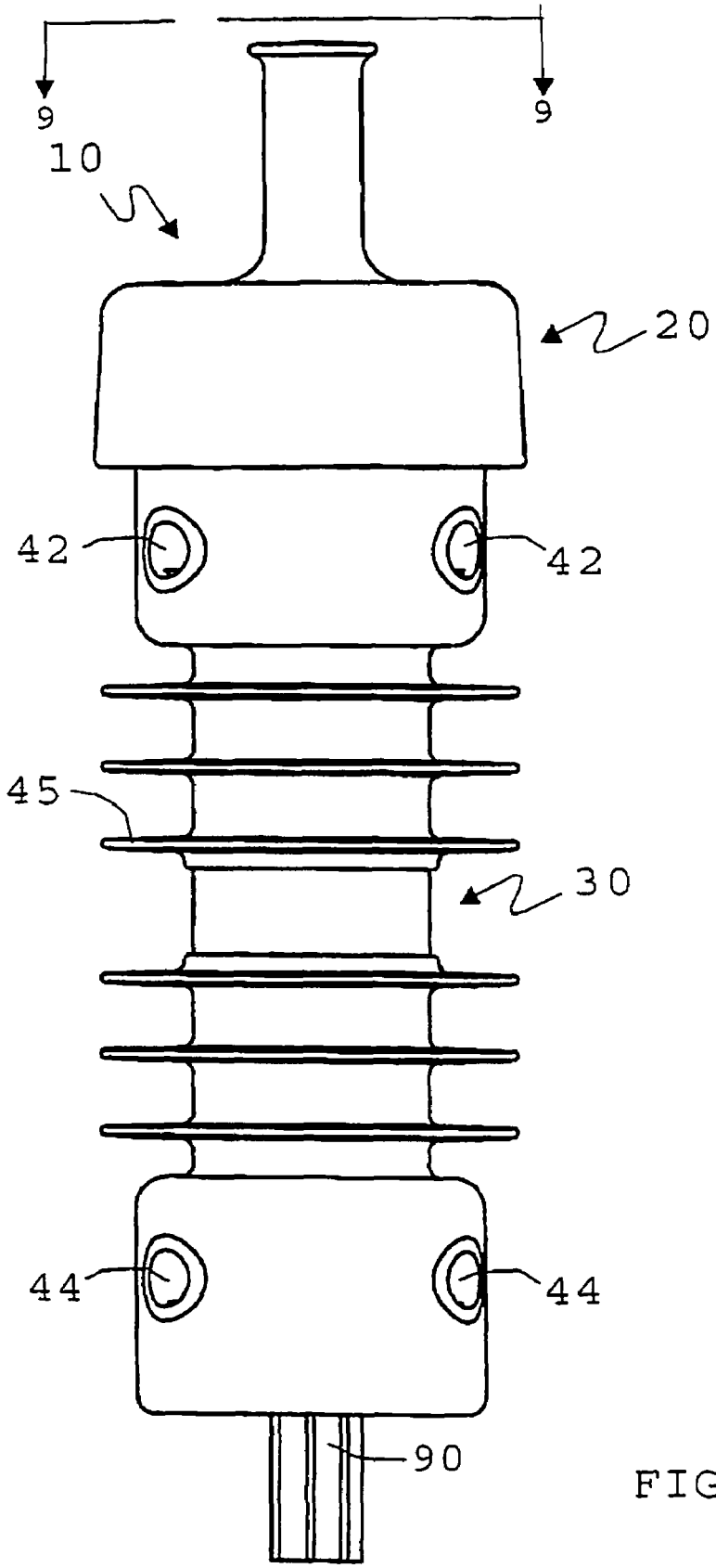
FIG. 2 is a front elevation view of an enclosed bayonet-type silicone cutout assembly, without clamp strap, with load interrupter installed onto the cutout fuse tube assembly according to the present invention.
Figure 16:
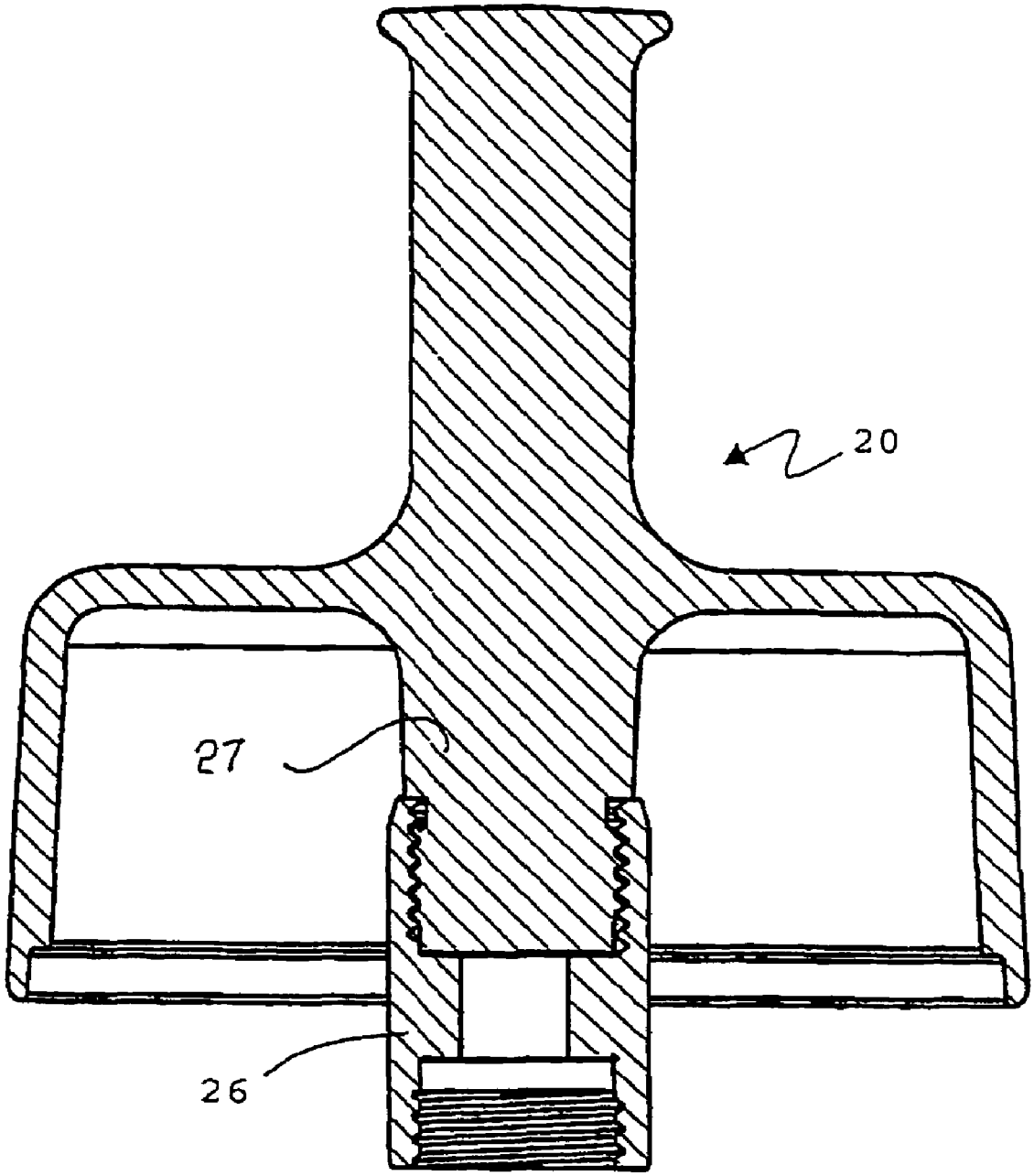
FIG. 16 is a side elevation in section view of the manual removable handle taken along line 2-2 of FIG. 1, FIG. 2, FIG. 3, and FIG. 4.

As best shown in section in FIG. 16, the removable handle 20 of FIGS. 1 and 2 is preferably made of a Durethan® core 24 with a polysiloxane covering 22 molded and bonded to the core. The inside center of the handle provides a rod-shaped protrusion 27 that extends downwardly into the body 30 when assembled. A threaded cylinder 26, preferably made of brass, is fitted onto the rod-shaped protrusion 27, and preferably affixed firmly to the handle with a suitable epoxy, glue or adhesive material (hereinafter collectively referred to as "epoxy"). One suitable epoxy is Epoxy Resin AW106MP mixed with Hardener HV953UMP, both of which are available from Golden Gate Chemical Co., Ltd. of Taipei Hsien, Taiwan. Either a cutout fuse tube assembly 50 (FIG. 7) or disconnect tube assembly 80 (FIG. 6) can be removably coupled to the handle 20 via the threaded cylinder 26, enabling the enclosed insulator assembly 10 (FIG. 1) to be respectively used as a circuit breaker or a disconnect switch. Accordingly, the top end of the tube assemblies 50, 80 are preferably threaded externally so as to mate with internal threads in the bottom portion of the threaded cylinder 26.

Figure 7:
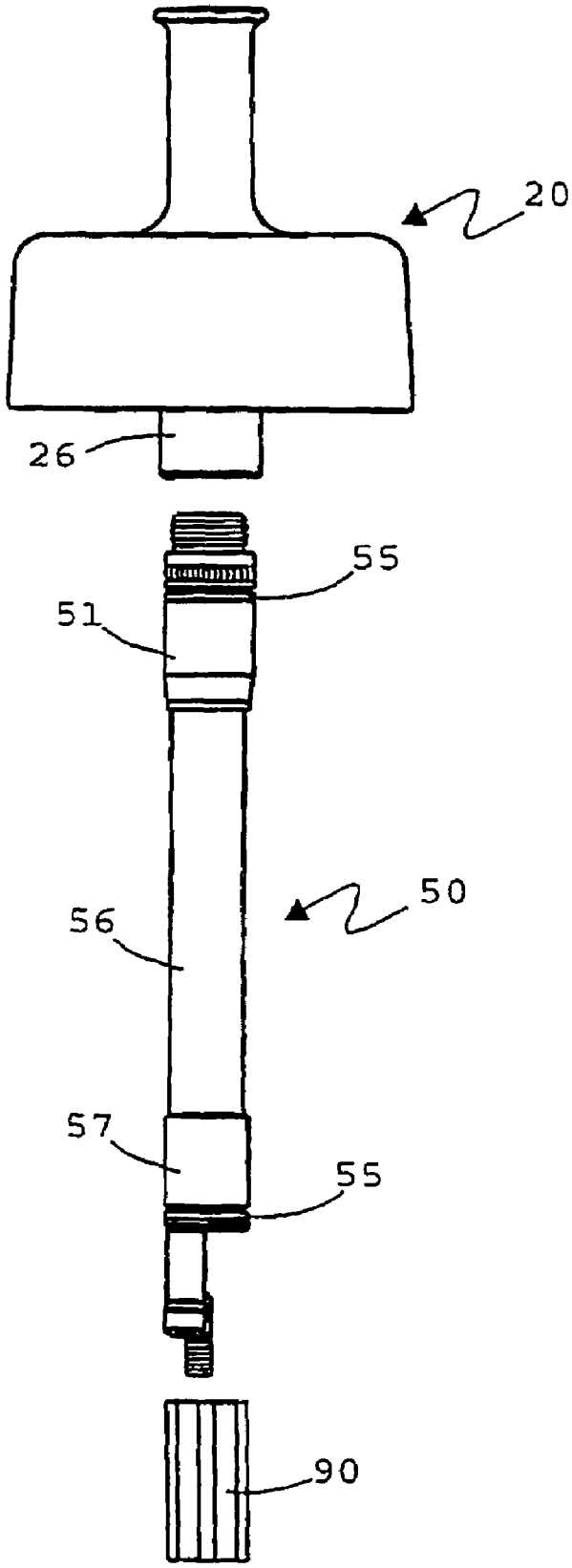
FIG. 7 is a front elevation view, in explosion, of a cutout bayonet assembly constructed in accordance with the invention and showing the handle, cutout fuse tube assembly with weather-resistant upper and lower O-rings, and grooved load interrupter attachment.
Figure 8:
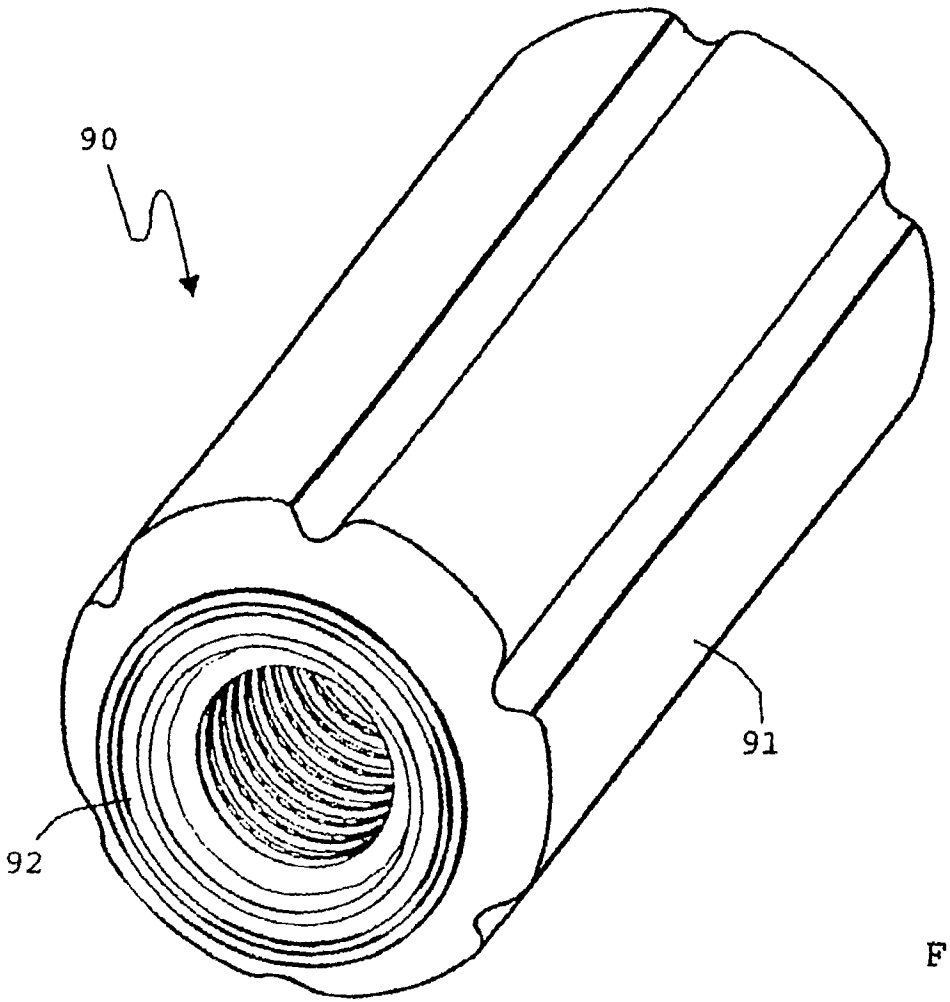
FIG. 8 is a bottom isometric view of a grooved load interrupter attachment shown in FIGS. 1-4 and 6-7.

As further illustrated in FIGS. 6 and 7, the bottom end of the tube assemblies 50, 80 are adapted to be coupled onto a grooved load interrupter 90, best illustrated in FIG. 8. The grooved load interrupter attachment 90 has a threaded brass insert 92 embedded at one end of a tube-shaped body 91 formed from epoxy material. Axially-extending grooves are formed on the exterior surface of the loaded interrupter. As shown in FIGS. 6 and 7, the tube assemblies 80, 50 are preferably coupled to the load interrupter 90 via the bottom fitting 88, 57 to form a "bayonet" that is inserted into body 30 to form a bayonet-type enclosed circuit breaker and a bayonet-type enclosed disconnect switch, respectively. In either case, the load interrupter 90 is thereby attached to the removable handle 20 as part of the bayonet thus formed. The load interrupter is used for arc suppression when the bayonet is withdrawn from the enclosure.

Figure 3:
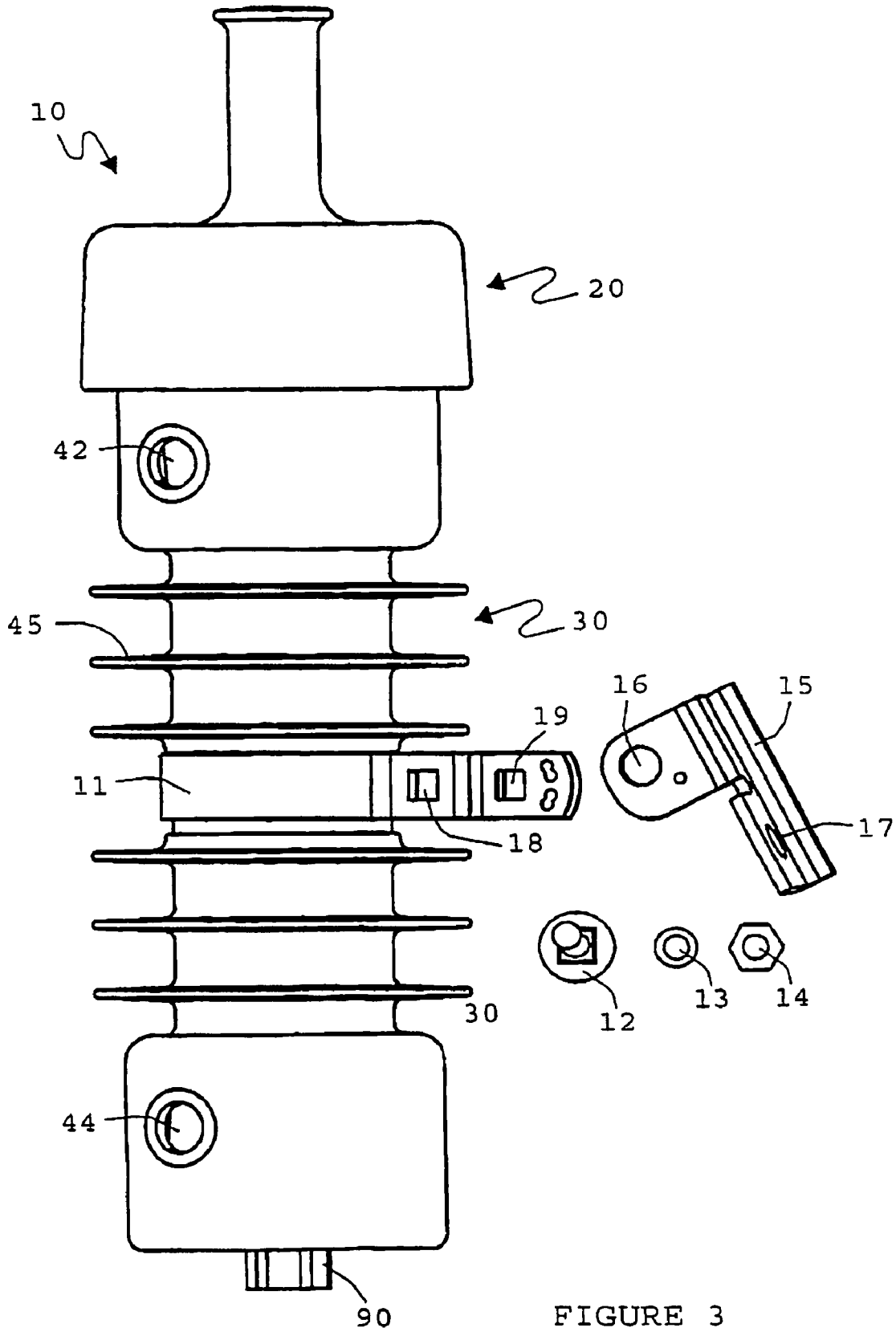
FIG. 3 is a rear elevation view of an enclosed bayonet-type silicone disconnect switch assembly with clamp strap.
Figure 4:
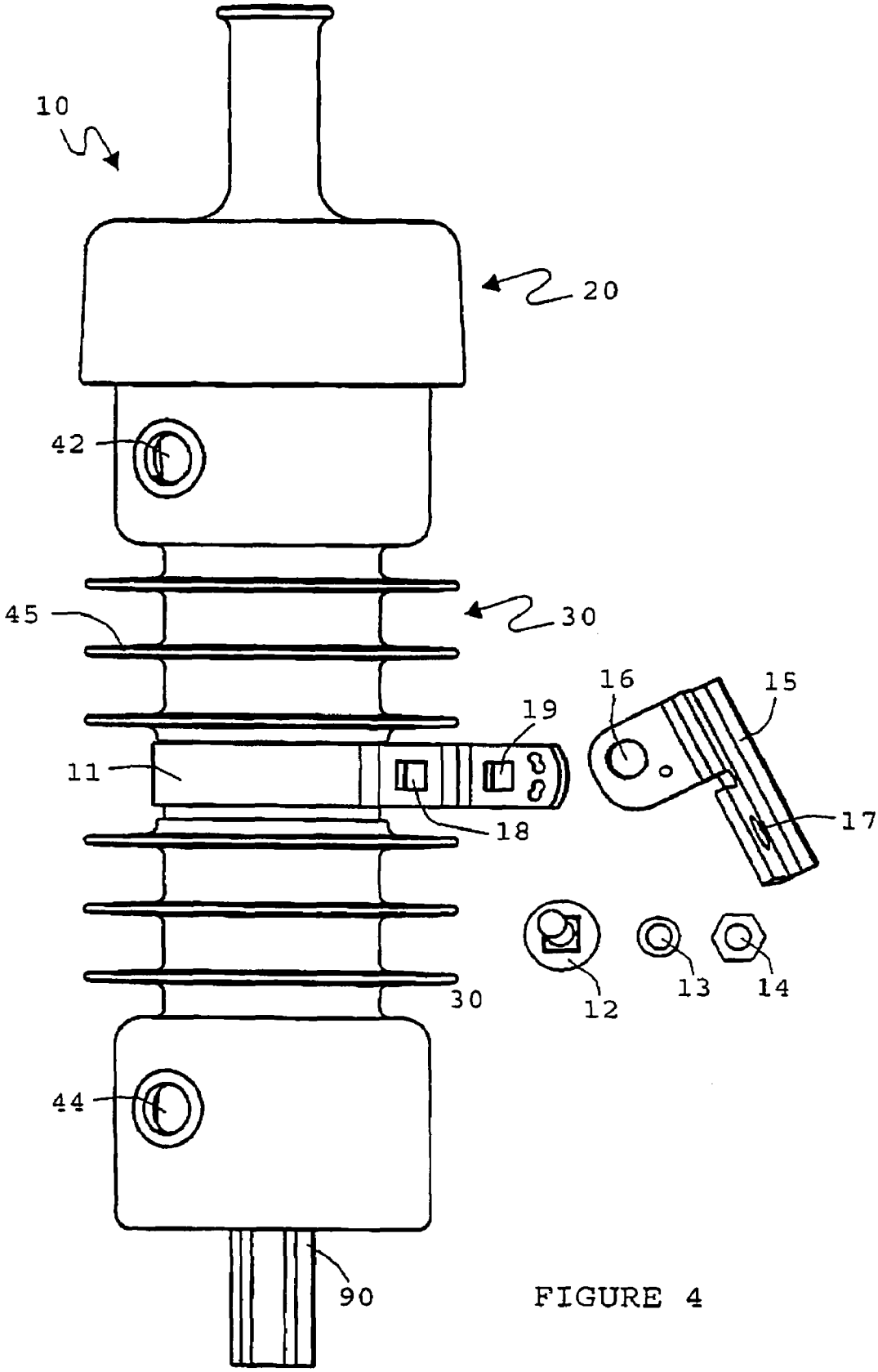
FIG. 4 is a rear elevation view of an enclosed bayonet-type silicone cutout assembly with clamp strap.
Figure 5:
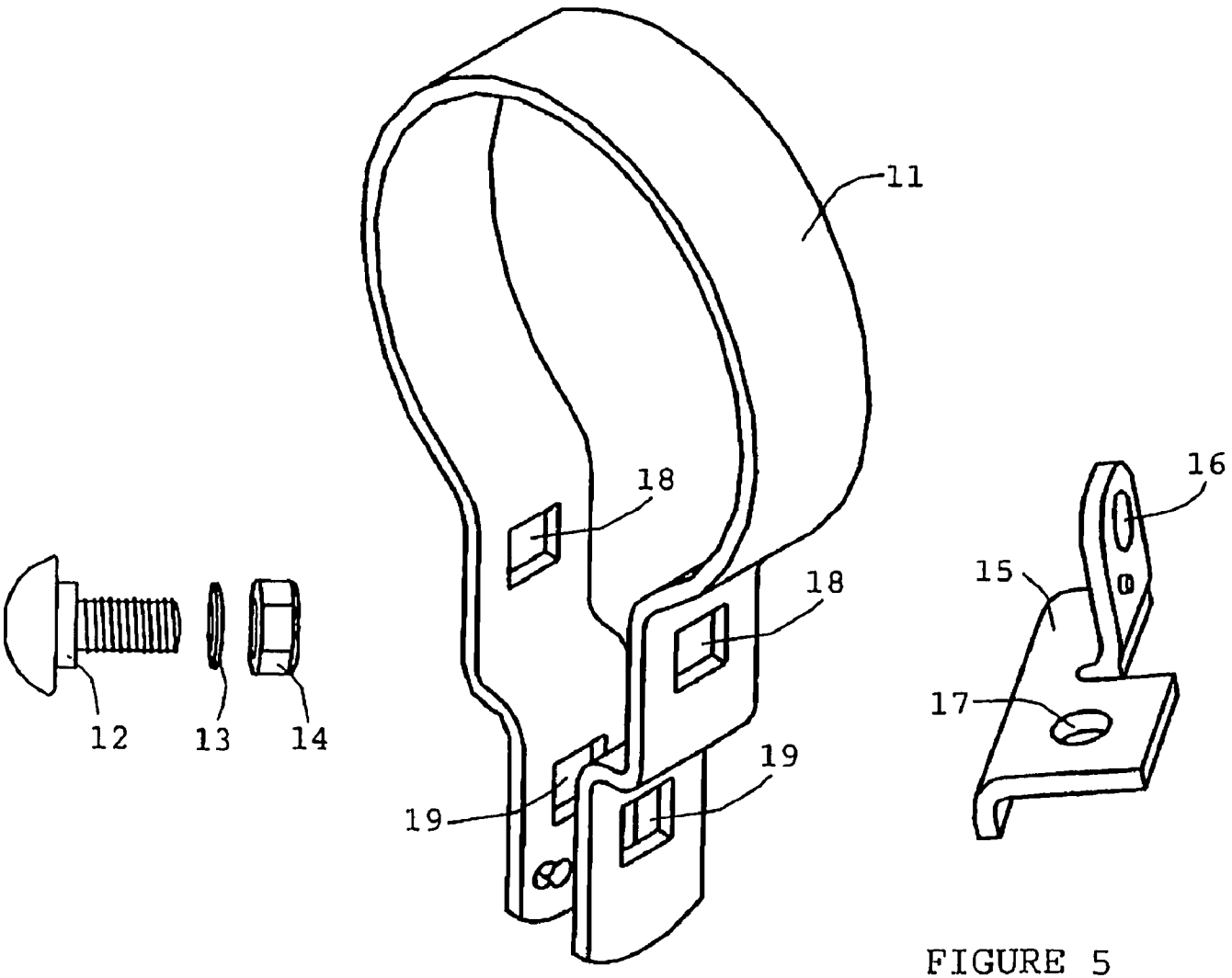
FIG. 5 is an isometric view of the clamp strap, bolt and nut shown in FIGS. 3 and 4.

As illustrated in FIGS. 3 and 4, a clamp strap 11 is fastened onto the mid-section of the body 30 with a bolt 12, lock washer 13, and nut 14. As shown in greater detail on FIG. 5, the clamp strap 11 is shaped to generally encircle the body 30, and has a pair of opposing legs which have opposing inner holes 18 and opposing outer holes 19. The strap is fastened onto the body 30 by inserting a bolt 12 through the opposing inner holes 18, and tightening a lock washer 13 and nut 14 onto the bolt in the conventional manner. A swivel bracket 15 is fastened between the clamp strap legs by placing its hole 16 between and in alignment with the outer holes 19 of the clamp strap 11, passing a second bolt 12 through the three holes 19, 16 and tightening a second lock washer 13 and second nut 14 onto said second bolt in the conventional manner. The swivel plate can be adjustably pivoted with respect to the body 30 by loosening the second bolt, positioning the swivel bracket and body with respect to each other as desired, and tightening the second lock washer and nut onto the second bolt.

Figure 15:
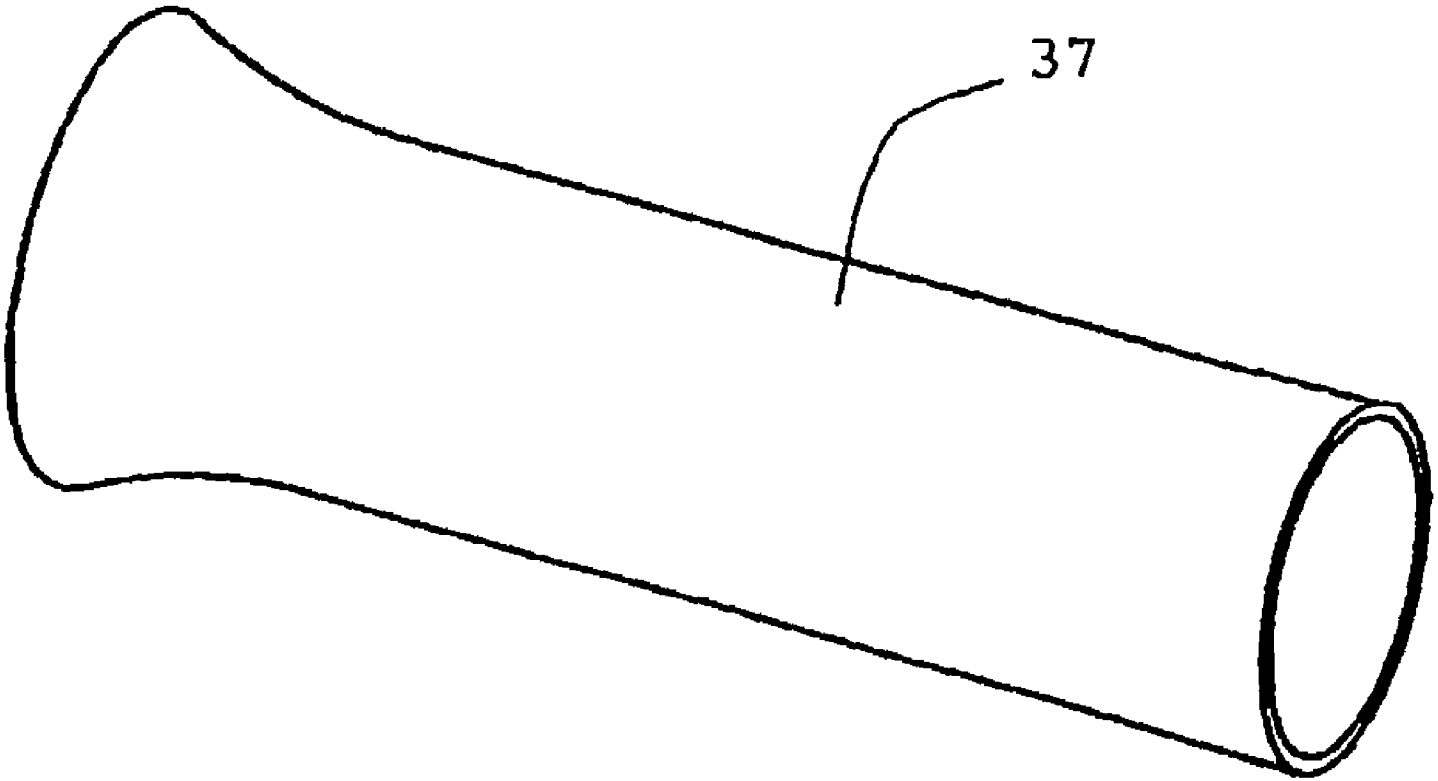
FIG. 15 is a view of the Delrin® tube shown in FIG. 9.

Returning to FIG. 9, the tubular body 30 preferably has a Durethan® inner core 32 with a polysiloxane covering 31 molded and bonded to the core. Within the mid-section of the body 30 is a generally co-axial tube 37 formed from a synthetic resinous plastic material such as Delrin®, having a large flared opening at its top. FIG. 15 is an isometric view of the tube 37. The tube 37 is aligned with, and held in place within, the core 32 by an upper terminal 33 and a lower terminal 38. The alignment permits a cutout fuse tube assembly 50 or disconnect tube assembly 80 to be inserted smoothly.

Figure 10:
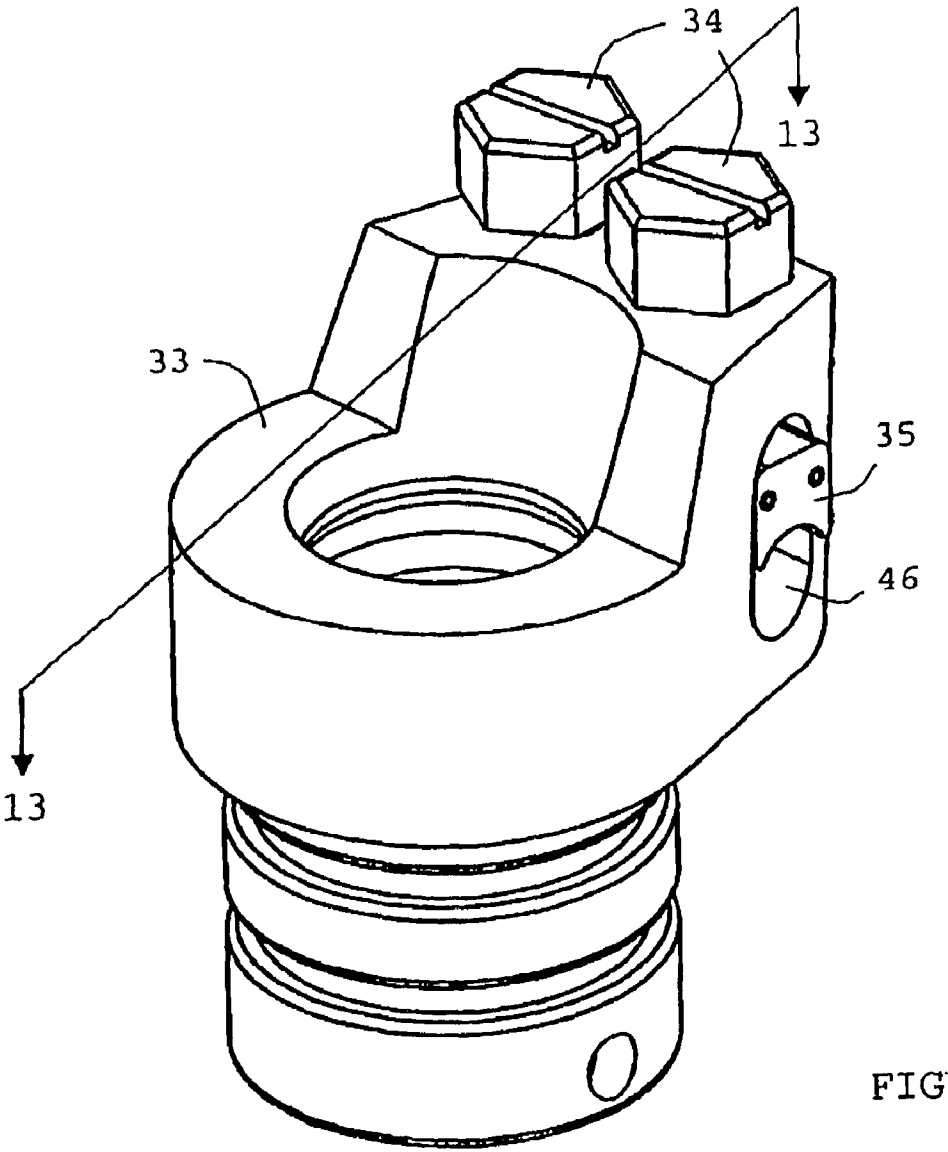
FIG. 10 is an isometric view of the upper terminal shown in FIG. 9.
Figure 11:
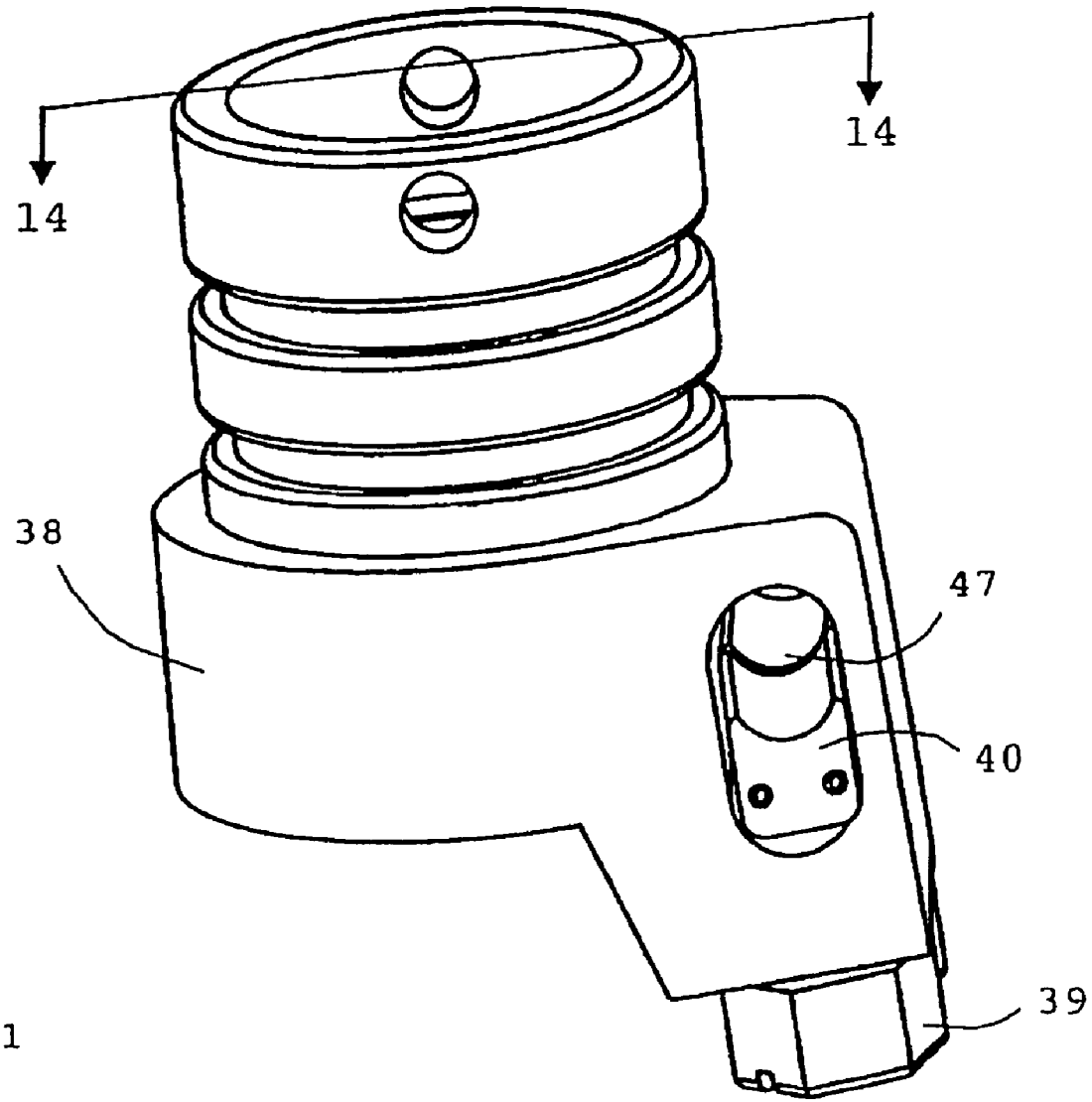
FIG. 11 is an isometric view of the lower terminal shown in FIG. 9.
Figure 12:
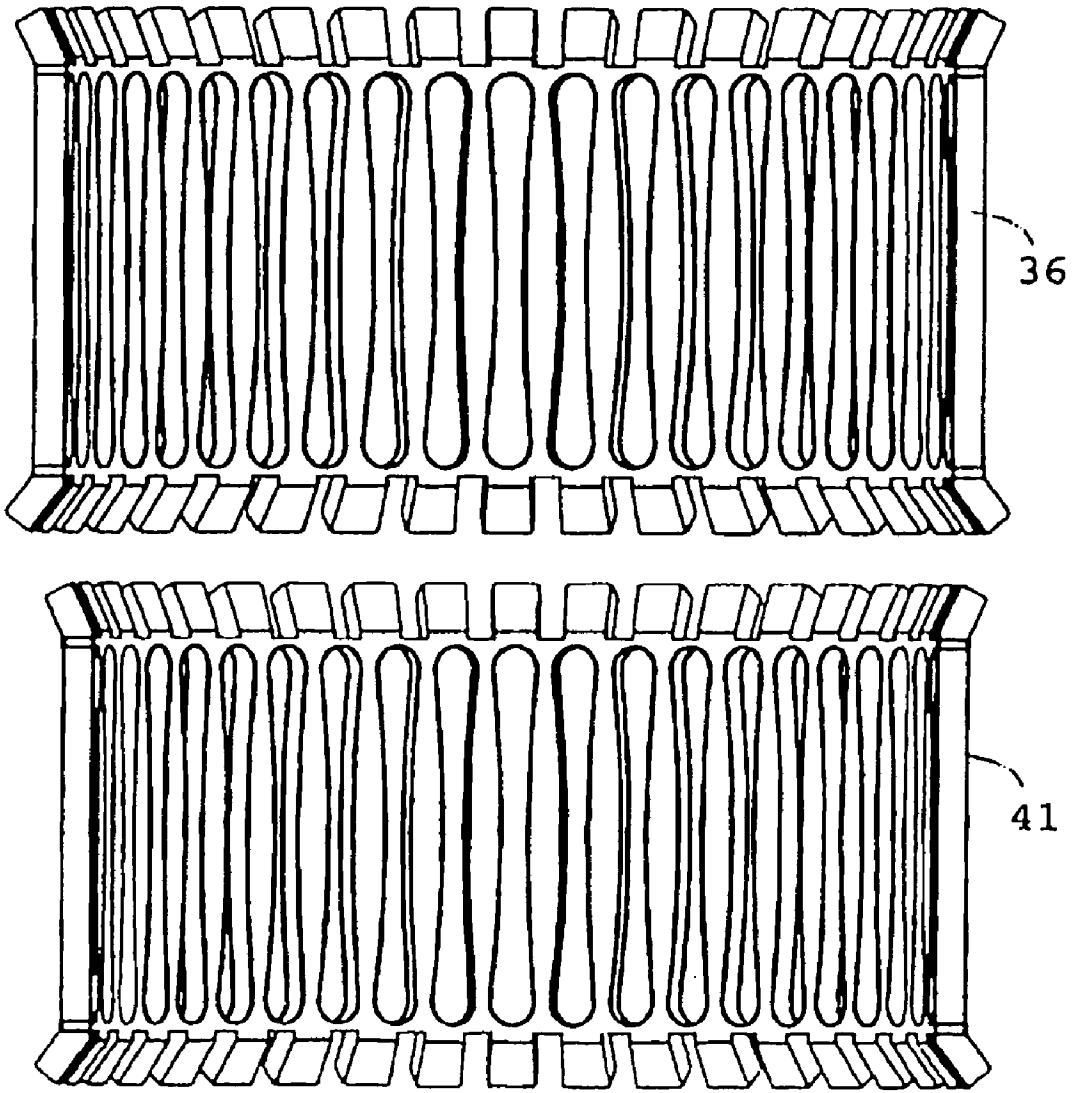
FIG. 12 is a detailed view of the Multilam™ contacts shown in FIG. 9.
Figure 13:
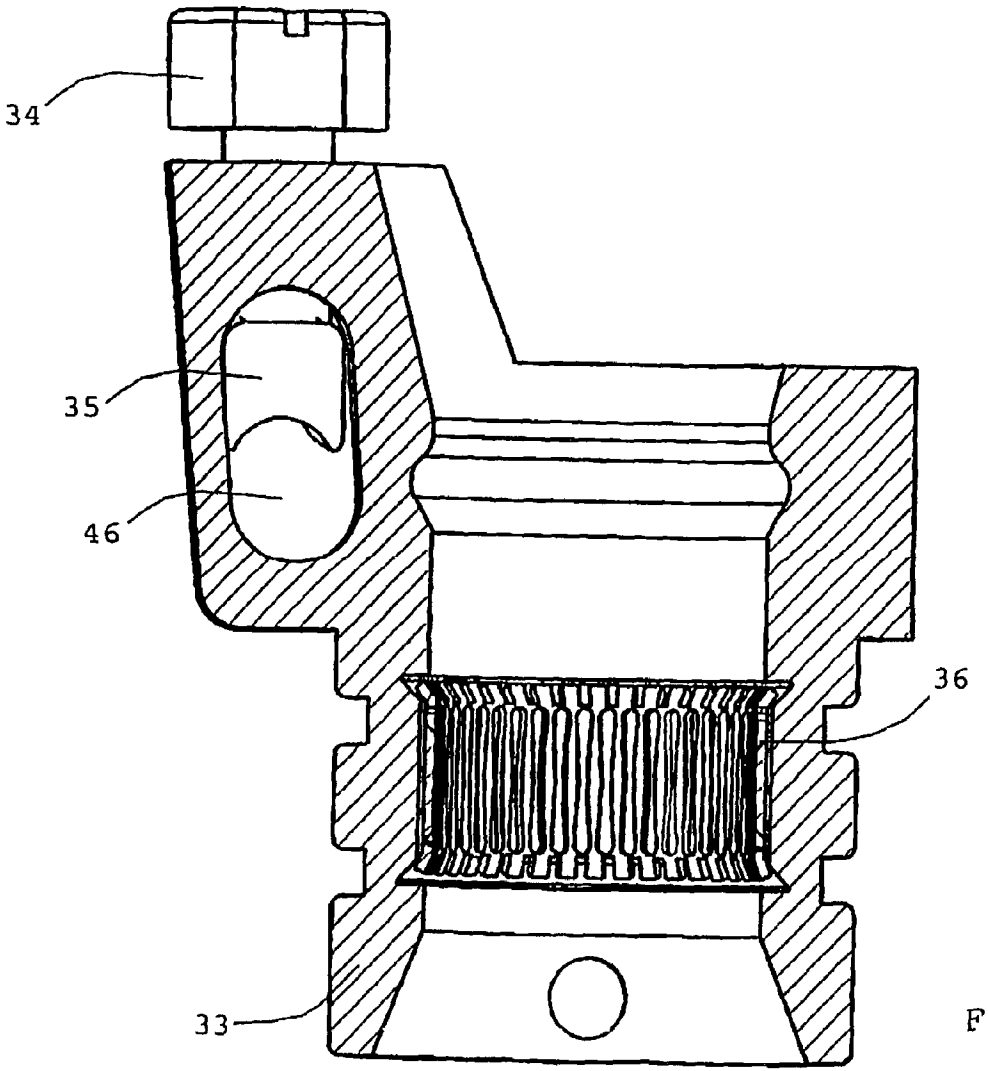
FIG. 13 is a side cross-sectional view taken along line 3-3 of the upper terminal shown in FIG. 10.
Figure 14:
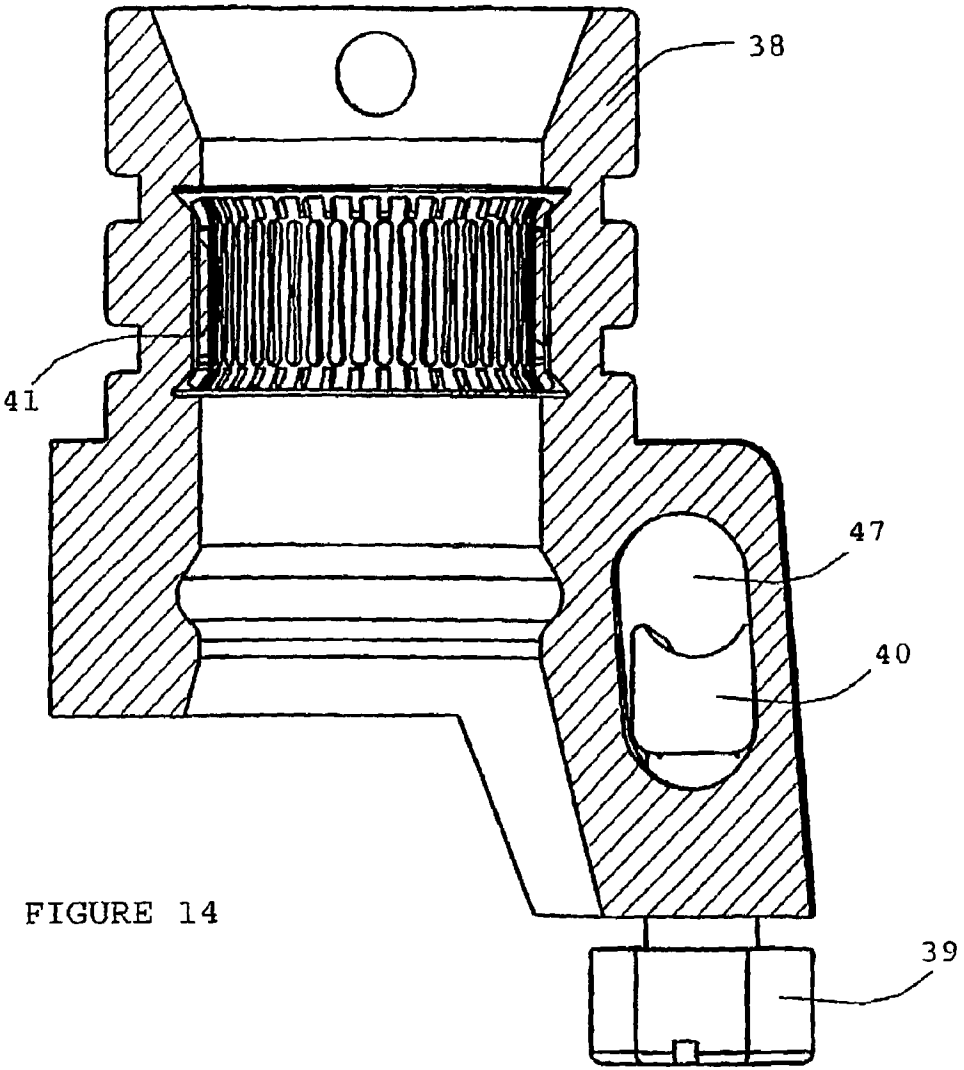
FIG. 14 is a side cross-sectional view taken along line 4-4 of the lower terminal shown in FIG. 11.

The upper and lower terminals 33, 38 are best illustrated in FIGS. 10 and 11, respectively, and comprise respective generally tubular bodies, within which (as shown in FIGS. 13 and 14 respectively), internally disposed bands of torsion or leaf spring contact elements 36, 41 are captured. Contact elements of this type are sold, for example, under the Multilam trademark, and are best shown in FIG. 12. The tubular opening of lower terminal 38 is preferably smaller than the tubular opening of upper terminal 33.

The contact element 36 ensures good physical and electrical contact with an electrically conductive upper fitting 81 of disconnect tube assembly 80 (FIG. 6) and with an electrically conductive upper fitting 51 for cutout fuse tube assembly 50 (FIG. 7), depending on which of the two assemblies are inserted into the tube 37 (FIG. 9). Similarly, contact element 41 ensures good electrical contact with an electrically conductive lower fitting 88 for disconnect tube assembly 80 (FIG. 6) and an electrically conductive lower fitting 57 for cutout fuse tube assembly 50 (FIG. 7) depending on which of the two assemblies are inserted into the tube 37 (FIG. 9).

The disconnect tube assembly 80 is generally of the type available from S&C Electric Company (Chicago, Ill.). Referring to FIG. 6, the disconnect tube assembly 80 preferably comprises of a metal tube 86 having an upper fitting 81 and a lower fitting 88. The upper fitting 81 and lower fitting 88 of the disconnect tube assembly 80 have respective grooves formed therein to accommodate respective O-rings 55 as shown in FIG. 6. Suitable O-rings are made from polychloroprene rubber (CR), have a hardness of 70 (JIS A), a tensile strength of approximately 21 MPa and a low temperature resistance (TR-10) of approximately −40° C. Examples are Mitsubishi's Neoprene JBP-25 and JBP-28 O-rings. Similarly, and as illustrated in FIG. 7, upper fitting 51 and lower fitting 57 of the cutout fuse tube assembly 50 have respective grooves formed therein to accommodate respective O-rings 55. The cutout fuse tube assembly 50 preferably comprises of a vulcanized fiber tube with a phenol paper wrapping. The lower fitting 57 is partially cut away at its bottom portion below the bottom O-ring 55 to permit the venting of gas when the fuse within the tube blows, and to provide a path for a fuse link to exit the tube when an indicator fuse is used. When the disconnect tube assembly 80 or cutout fuse tube assembly 50 is inserted into place within body 30, the O-rings 55 inhibit air flow where the contacts elements 36 and 41 are in contact with upper fittings 81 and 51 and lower fittings 88 and 57, respectively.

As shown in FIG. 8, a grooved load interrupter attachment 90 has a threaded brass insert embedded at one end of a tube-shaped epoxy material 91. The load interrupter 90 is attached to either lower fitting 88 or 57 and subsequently to handle 20 to form a bayonet. As the bayonet is withdrawn from the resinous plastic tube 37 as the handle is pulled out, an electric arc may be generated between the lower fitting 57, 88 and the interior of the resinous plastic tube 37. The size and shape of the load interrupter causes the arc, as well as any gas generated from the interior wall of the tube by the arc, to be compressed between the load interrupter and tube wall in a manner that promptly extinguishes the arc. The diameter of the load interrupter must accordingly be of sufficient size to minimize the gap between it and with the interior wall of tube 37 (FIG. 9) so as to force the arc and gas into the grooves. Moreover, it is desirable for the load interrupter to be firmly affixed to the bayonet, even if manually removable when desired, so that it's axially directed travel and rate of travel coincides with that of the bayonet's fitting.

Assembly and Disassembly

As shown in FIG. 10, upper terminal 33 is machined to shape with jumper cable hole 46. Pressure equalizer 35 is inserted into hole 46. Bolts 34 are then screwed into the upper terminal and into the pressure equalizer. The securing bolts within the pressure equalizer are then tightened to hold the bolts and equalizer together.

As shown in FIG. 11, lower terminal 38 is machined to shape with jumper cable hole 47. Pressure equalizer 40 is inserted into hole 47. Bolts 39 are then screwed into the lower terminal and into the pressure equalizer. The securing bolts within the pressure equalizer are then tightened to hold the bolts and equalizer together.

As shown in FIGS. 13 and 14, an inner channel is machined in the upper and lower terminals so that contacts 36, 41 can be installed into upper terminal 33 and lower terminal 38, respectively.

The upper terminal 33, Delrin® tube 37, and lower terminal 38 are then aligned with a rod. During this step, the jumper cable holes in the upper and lower terminals are also aligned to one another. Once the alignments are completed, a Durethan® core 32 is molded around the tube 37 and portions of the terminals 33, 38, as shown in FIG. 9. The ends are flared out with large open ends. Along the walls are holes 42 and 43 which are aligned with jumper cable holes 46 and 47, respectively.

Once the core molding process is complete and the alignment rod removed, a polysiloxane insulator 31 is molded and bonded on the core to form insulator body 30. Multiple sheds 45 are made during this process.

As shown in FIGS. 3 and 4, clamp strap 11 is fastened onto the mid-section of body 30 with bolt 12, lock washer 13, and nut 14 through the inner clamp strap holes 18. A swivel bracket 15 is fastened between the clamp strap ends through the outer clamp strap holes 19 and swivel bracket hole 16 with bolt 12, lock washer 13, and nut 14. Swivel bracket hole 17 receives a fastener to secure body 30 to a utility pole or other suitable support. This completes the insulator body.

As shown in FIG. 16, handle 20 is made of a Durethan® core 24 with a polysiloxane insulator coating 22 molded and bonded onto the core. At the inside center of the handle, there is a rod-shaped protrusion extending outward. A threaded brass cylinder 26 is screwed onto the bar and glued into place. A preferred glue is an AB glue CIBA having a rated strength of greater than 50 kg. This eliminates the use of lead in securing the tube assemblies to the handle, as in prior art devices.

As shown in FIGS. 6 and 7, the upper and lower end fittings for the disconnect tube assembly 80 and cutout fuse tube assembly 50 are machined to accommodate respective O-rings 55 onto each fitting. As shown in FIG. 8, a grooved load interrupter attachment 90 is made to fit onto the lower end fitting. The attachment is made of molded epoxy 91 with a threaded nut insert 92 at the top.

A bayonet is formed when a disconnect tube assembly 80 with grooved load interrupter 90 is installed into threaded cylinder 26 on the handle 20. Insertion of this bayonet into body 30 creates a bayonet-type disconnect switch.

A different bayonet is formed when a cutout fuse tube assembly 50 with grooved load interrupter 90 is installed into threaded cylinder 26 on the handle 20. Insertion of this bayonet into body 30 creates a bayonet-type cutout.

Disconnect tube assembly 80 and cutout fuse tube assembly 50 are interchangeable. A disconnect switch can thereby be converted into a circuit breaker by replacing the disconnect tube assembly with a cutout fuse tube assembly. Similarly, a circuit breaker can thereby be converted into a disconnect switch by replacing the cutout fuse tube assembly with a disconnect tube assembly.

I claim:

1. An enclosed insulator assembly for high-voltage distribution systems comprising:

a generally tubular axially-extending outer body formed from a non-brittle, electrically insulative thermoplastic material lighter in weight than porcelain and having a manually removable handle, the outer body having at least one entranceway for permitting cables electrically coupled to the distribution system to enter into the interior of the body;

a threaded cylinder mounted generally coaxially onto the inside of the handle and affixed thereto with epoxy;

an axially-extending threaded tube assembly threadably and securely engaging said cylinder so as to be removable with said handle as a detachably integral component thereof, said tube assembly being selected from the group comprising of cutout fuse tube assemblies and disconnect tube assemblies;

an axially extending load interrupter coupled to the tube assembly axially opposite the handle, the load interrupter having a generally tube-shaped body formed from epoxy material and having a plurality of axially extending grooves on its outer periphery, and a plastic tube mounted within the outer body and having first and second terminal means adapted to be electrically coupled to the cables, the plastic tube having an inner dimension accommodating the insertion therein of the tube assembly, the tube assembly having first and second connection means for electrically coupling to the distribution system via the first and second terminal means of the plastic tube, the internal dimension of the plastic tube and the external dimension of the load interrupter being such that any electric arc created as the tube assembly is withdrawn from the plastic tube is compressed and suppressed therebetween; and a pair of sealing rings respectively positioned with respect to the plastic tube and tube assembly to inhibit air flow in the regions where the first and second terminal means are coupled to the first and second connection means.

* * * * *